US005282350A

United States Patent [19]

Crowley

[11] Patent Number: 5,282,350

[45] Date of Patent: * Feb. 1, 1994

[54] HIGH SPEED INSERTER FED FROM ROLL MATERIAL

[75] Inventor: H. W. Crowley, Newton, Mass.

[73] Assignee: Roll Systems, Inc., Burlington, Mass.

[ * ] Notice: The portion of the term of this patent subsequent to Aug. 18, 2009 has been disclaimed.

[21] Appl. No.: 886,420

[22] Filed: May 20, 1992

Related U.S. Application Data

[63] Continuation of Ser. No. 774,791, Oct. 10, 1991, Pat. No. 5,138,821.

[51] Int. Cl.[5] ..... B65B 61/04; B65B 5/06; B65B 35/50

[52] U.S. Cl. ..... 53/435; 53/168; 53/55; 53/284.3; 53/381.5; 53/520

[58] Field of Search ..... 53/55, 52, 77, 493, 53/429, 435, 284.3, 520, 117, 116, 168, 381.5, 381.7, 387.2, 387.1; 229/69

[56] References Cited

U.S. PATENT DOCUMENTS

| | | | |
|---|---|---|---|
| 1,424,780 | 8/1922 | Sea | 229/69 |
| 3,325,071 | 6/1967 | Schmitz | 53/168 UX |
| 3,776,081 | 12/1973 | Becker | 53/168 UX |
| 3,815,313 | 6/1974 | Heisler | 53/168 X |
| 3,987,931 | 10/1976 | Fell et al. | 229/69 X |
| 4,020,615 | 5/1977 | Irvine et al. | 53/266 A X |
| 4,525,788 | 6/1985 | Gottlieb et al. | 364/478 |
| 4,804,135 | 2/1989 | Bourbeau | 229/69 |
| 4,821,493 | 4/1989 | Pintsov | 53/168 X |
| 4,939,888 | 7/1990 | Katz et al. | 53/435 X |

*Primary Examiner*—James F. Coan
*Attorney, Agent, or Firm*—Wolf, Greenfield & Sacks

[57] ABSTRACT

A method and apparatus for selective high-speed insertion of sheets from a plurality of webs into envelopes provides a mechanism for folding and inserting sheets into preformed envelopes. Preformed envelopes are provided for folding and inserting from a source that may be a roll. A plurality of sheets are fed for folding and inserting into an envelopes. A leading sheet from each of the webs is selectively driven and cut at a collection point for folding and inserting. The selecting of sheets for feeding and cutting may be accomplished by means of a CPU that may include a bar code detection system disposed along each of the webs. A system for widening the openings of envelopes to facilitate insertion of contents may also be included. This system may comprise a strip along each of the envelopes is a stream that includes a folded section within each opening or may comprise tabs disposed along an opening side of each envelope.

51 Claims, 4 Drawing Sheets

HIGH SPEED INSERTER FED FROM ROLL MATERIAL

This application is a continuation of application Ser. No. 07/774,791 filed on Oct. 10, 1991 now U.S. Pat. No. 5,138,821.

FIELD OF INVENTION

This invention relates to a high speed envelope contents inserter and more particularly to an inserter that stores envelopes and letter contents in a roll form prior to insertion.

BACKGROUND OF INVENTION

A large volume of the world s mail comprises letters fed into envelopes using a machine called an inserter. Large volume inserters have been manufactured by companies such as Bell & Howell and Pitney-Bowes. Traditionally, the automatic feeding of letters into envelopes involved the positioning of stacks of paper or a stream of continuous paper on a raceway that carries various sheets of paper in a predetermined manner to the inserter which holds a stack of at least 500 envelopes in a hopper that may be more than 15" high. When each set of combined sheets reaches the inserter, the sheets are folded and placed into a waiting envelope. The envelope may then be sealed or left open for further contents insertion and output from the inserter.

In the past, each piece of material to be fed into a particular envelope had to be sent down the raceway to the envelope one piece at a time in a prechosen order until the envelope was filled. More recently industry has developed means for gathering different sheets and materials in a separate sub-hopper that receives the various contents to be inserted from a variety of sources, gathers them into one packet (such as a multiple page letter or statement) and then transfers this packet down the raceway to the inserter. Such secondary gathering speeds the overall process of insertion by allowing all sheets to enter the inserter simultaneously.

Even more recently, devices for transferring a number of webs from a roll to a common cutting point where the webs are cut and folded into one packet have been employed by high volume mailers. The transferred webs are all fed and cut simultaneously. One of the cut webs is, in fact, the envelope which is subsequently formed and wrapped around other sheets in the group. Finally, the folded sheets for insertion have been fed from large rolls and nested with each other to create a single insert that has, generally, been utilized as part of the contents of a magazine or a newspaper.

However, to date it has not been possible to feed printed webs from a plurality of rolls to a single device that selectively cuts some or all of them, based upon a preprogrammed sequence, and subsequently inserts them into a separate envelope. Additionally, the opening of envelopes for insertion has been problematic. Highly specialized equipment has been necessary to spread an envelope opening sufficiently to allow insertion of contents.

SUMMARY OF INVENTION

It is therefore an object of the present invention to provide an apparatus for high speed insertion of contents from rolls into separately fed envelopes.

It is another object of this invention to provide an apparatus that allows insertion of preselected contents from a plurality of converging rolls with separate control of each roll.

It is another object of this invention to provide an apparatus that allows individual scanning of fed webs to determine appropriate contents to be inserted into a given envelope.

It is another object of this invention to provide an apparatus that eliminated the need to separate envelopes into different stacks on the basis of type of envelope or contents.

It is another object of this invention to provide an apparatus that allows larger containers of bulk envelopes to be processed at one time.

It is yet another object of this invention to provide an apparatus that allows quick opening of envelopes for contents insertion as they are fed to an insertion location.

An apparatus and method for selective high speed insertion of sheets from a plurality of webs according to a preferred embodiment features folding and inserting of sheets into preformed envelopes. Preformed envelopes are provided, for folding and inserting of contents thereinto, from a source that may include a roll having a retaining strip to maintain the envelopes in a predetermined alignment. A plurality of sheets are fed for folding and inserting into the envelopes. The sheets are selected from leading sheet sections of each of a plurality of continuous webs. The leading sheet sections of continuous webs are selectively cut at a collection point at which all of the webs converge. The cut sheets are subsequently transferred in a stack to be folded and inserted into envelopes. The selecting of sheets and the feeding of the sheets for cutting is accomplished by means of a CPU that ma include web disposed bar codes and overlying bar code detectors or similar preprogrammed instructions in order to determine which sheets are fed and cut for a particular insertion into an envelope.

The method and apparatus may further comprise a system for spreading the opening sides of an envelope to facilitate quicker insertion of contents thereto. This spreading may be accomplished by means of a strip disposed along each of the envelopes in a stream and having a fold positioned in each of the openings whereby a downstream-most envelope would be spread by pulling upon the downstream most end of the strip.

According to an alternative embodiment, the spreading of an enveloping sides may be accomplished by means of tabs disposed along one opening side that may be gripped by a finger or similar device to pull one opening side away from the other. The tabs may be removable by a variety of methods including perforations and removal of adhesive-backed tabs.

BRIEF DESCRIPTION OF THE DRAWINGS

The foregoing and other objects and advantages of the invention will become more clear with reference to the following detailed description and drawings in which.

DETAILED DESCRIPTION OF THE PREFERRED EMBODIMENT

Figure 1:
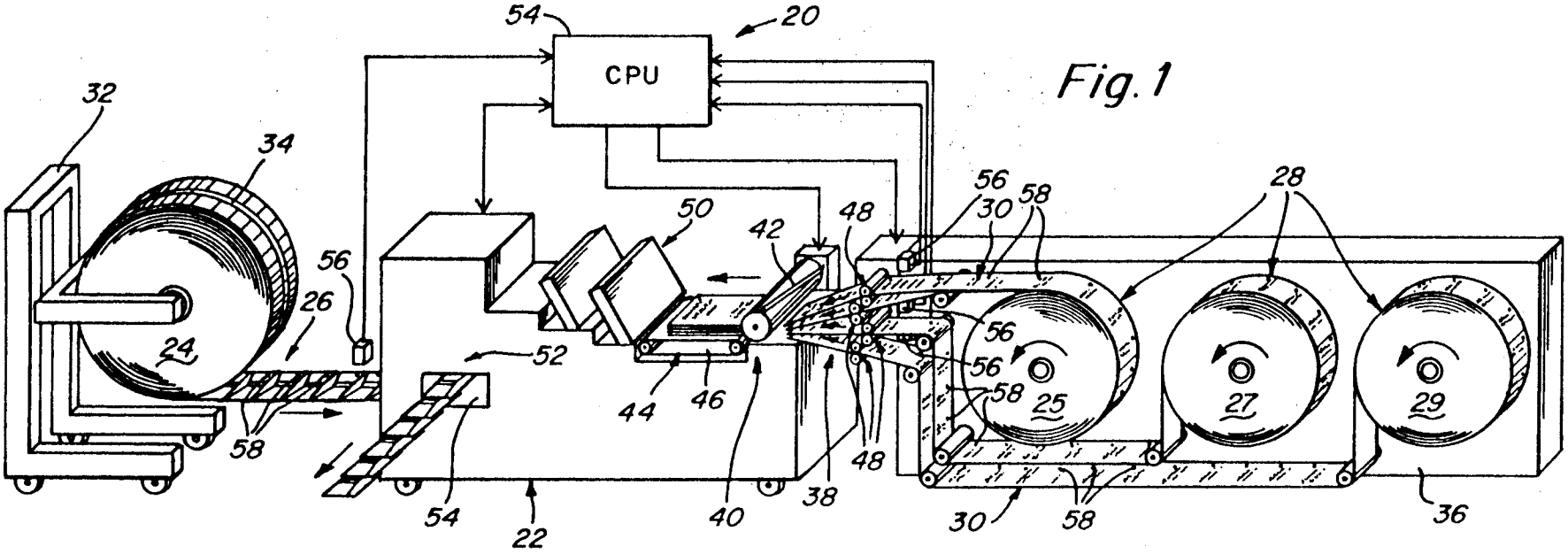
FIG. 1 is a schematic diagram of an apparatus for high speed insertion of contents into envelopes according to this invention.

An overview of a high speed inserter for placing multiple independently selected sheets into individual envelopes is depicted schematically in FIG. 1. The apparatus 20 comprises a folder/inserter unit 22 that is fed simultaneously by a continuous roll 24 of finished folded envelopes 26 and, in this embodiment, three overlaid rolls 28 (first roll 25, second roll 27 and third roll 29) of printed web 30.

The envelopes 26 are mounted on a roll stand 32 that may be similar to that disclosed and claimed in Applicant's prior U.S. Pat. Nos. 4,893,763 and 5,000,394. The envelopes 26 themselves are mounted in a roll 24 using a tensioned retaining strap 34 that holds them against the roll 24 and that unwinds as the envelopes 26 are unrolled. Such a system is also described in Applicant's co-pending patent application Ser. No. 07/714,232.

The web rolls 26 in this embodiment may be mounted upon a multi-roll stand 36 as shown or may be mounted on individual roll stands as described in the above identified patents. These webs are mounted in such a manner that their leader sections 38 overlap one another and all converge at one side of the folder/inserter unit 22. In particular, the webs 30 overlie each other at a feeding, cutting and folding portion 40 of the folder/inserter at which, in this example, includes a rotary blade 42. At the feeding, cutting and folding section, leader or end sheet sections 38 of each web are combined and overlaid upon one another. The overlaying, in this embodiment, particularly occurs at a conveyor 44 that is depicted as conventional belt 46 in this example. Each web leader 38 is fed in response to a command by a set of web drive feed rollers 48 or similar drivers to the conveyor. At this point the web leader's rear (upstream) edge is disposed proximate the blade and is cut to create an appropriately sized sheet at the overlay position. The conveyor moves the overlaid (stacked) pieces into a folder 50 that folds the sheets into a three fold standard letter or other folded configuration for insertion into appropriate sized envelopes.

The actual insertion of folded sheets into envelopes occurs in the inserter section 52 of the folder/inserter unit 22 and is performed by conventional methods (not shown). The completed envelopes are moved in a stream out of the unit 22 at an outlet port 54.

With further reference to FIG. 1, each of the folder/inserter 22 , rotary blade 42 and web feed drives (as well as the envelope feed drive) 48 are controlled by a programmable central processing unit (CPU) 54 in this embodiment. The CPU may carry preprogrammed parameters for loading predetermined contents from each of webs 30 into predetermined envelopes 26 as they are fed. If the CPU 54 does have such instructions, as each envelope is fed to the inserter 52, the CPU 54 instructs the feed rollers to advance certain desired printed leader sections under the blade 42 and then to cut the leader into separated sheets as they overlay the conveyor 44. Alternatively, the envelopes and web sheet sections may pass through a bar code or similar code detection device 56 that is interconnected with the CPU 54. Predetermined bar codes 58 upon each of the envelopes and web sections may serve to signal the CPU 54 to perform feeding and cutting operations based upon a preprogrammed sequence. An example of such and envelope/sheet insertion detection system, using a single web roll only, is described in Applicant's co-pending patent application Ser. No. 07/714,232. Note that such a system, utilizing bar codes on both envelopes and webs may serve to maintain an error checking comparison between envelopes and their contents to ensure a correct match up.

Figure 2:
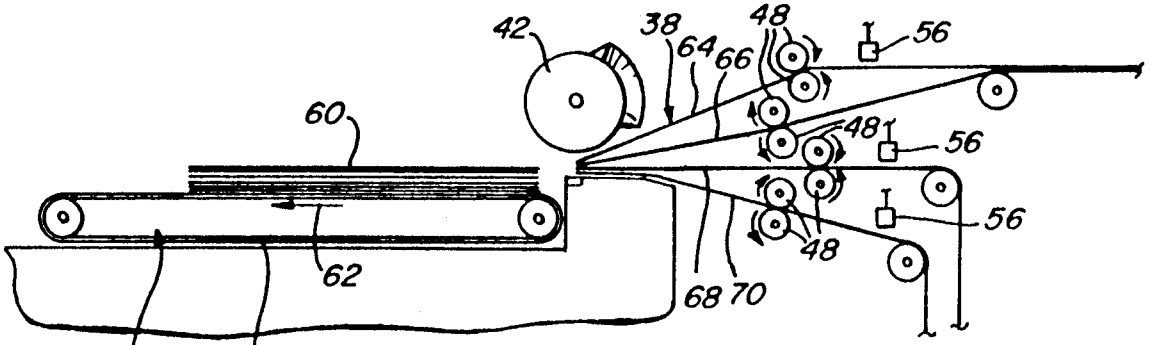
FIG. 2 is a more detailed schematic side view of the cutting and feeding of individual sheets in the apparatus of FIG. 1.
Figure 3:
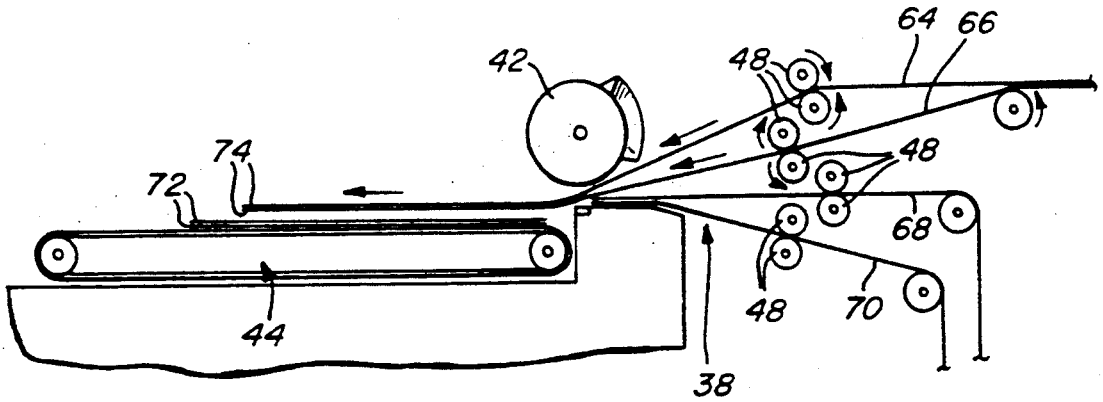
FIG. 3 is a schematic side view of the cutting and feeding of three elements of FIG. 2 showing the feeding of sheets from a first rolls.
Figure 4:
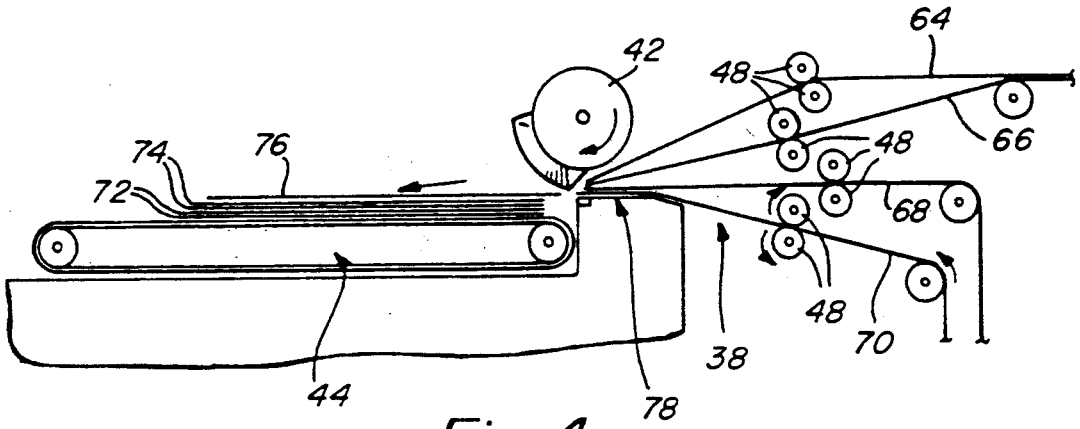
FIG. 4 is a more detailed schematic side view of the cutting and feeding elements of FIG. 3 showing subsequent feeding of sheets from a third roll.

The mechanics of the web feeding and cutting system 40 according to this invention are detailed in FIGS. 2–4. FIG. 2 depicts a stack of sheets 60 positioned upon the conveyor 44. The conveyor belt 46 moves in a downstream direction as depicted by the arrow 62. The leading section of each sheet is fed to the overlay position upon the conveyor 44 by means of pairs of independent feed rollers 48 that move according to the arrows to drive each corresponding web. The first or upper web 64 in this embodiment, optionally includes a slit and merged web that is separated, as shown, into two sections 64 and 66 and, thus, requires two corresponding sets of feed rollers 48 in this example. Both of these sets of feed rollers 48 would act simultaneously. It is possible to provide only one set of feed rollers 48 for the slit and merged web sections 64 and 66 prior to their separation point according to an alternative embodiment.

Each set of feed rollers 48, as noted, acts independently allowing any of the three webs (upper 64 and 66, middle 68, and lower 70) to be fed to the overlay position on the conveyor 44 at any time. This facilitates selective ordering of sheets in a given stack. In this embodiment, the first sheets to be fed from any of the web rolls will lie at the bottom while subsequent sheets will cover these bottom sheets and stand at the top of the stack. It is possible, to have three sheets in a row fed from one web roll and then only one or no sheets fed from another roll to form a particular stack. Such an ordering may be determined, as noted above, by the specific bar code instructions on fed web sections that are detected at each detector. In addition, if two or three overlaid leading web sections from different rolls are presented simultaneously to the cutter 42, it is possible to feed all of these leaders forwardly onto the overlay position at the same time, and cut all three of them into sheets simultaneously creating a finished stack. In other words, it is not necessary to feed each sheet independently, one at a time, and cut it independently when a predetermined order already exists at the overlapped uncut leader sections of the webs.

A particular example of a feeding order according to this embodiment is depicted in FIGS. 3–4. In FIG. 3, two sheets 72 have already been fed onto the conveyor 44 by one or more of the web rolls. At this time, the feed rollers 48 move the leading edge of the upwardmost disposed slit and merged web sections 64 and 66 into position. When the sheets 74 from the upper web 64 and 66 have been fed forward a sufficient distance, the cutter 42 is then activated, separating the leading overlapping sheets 74 from the remaining web. Since this cutter is a rotary blade, this operation, according to this embodiment, will occur as the web moves downstream. In FIG. 4, the four sheets 72, 74 are already in position and a fifth sheet 76 from the third web 70 is now fed and cut in a position overlying sheets 72 and 74. As clearly shown, the particular order of webs at their convergence (collection point 78) has no bearing upon the final stacking order of web sheets on the conveyor 44. In this example, a bottom web (third roll 29) places a top sheet 76 on the stack while the top web (first roll 25) places the bottom sheets 72, 74 on the stack. Again, sheets from more than one web may be fed simultaneously and cut simultaneously if the predetermined order of stacking is already present within the leader sheets of the webs themselves as they overlie each other at the collection point 78 during feeding.

Figure 5:
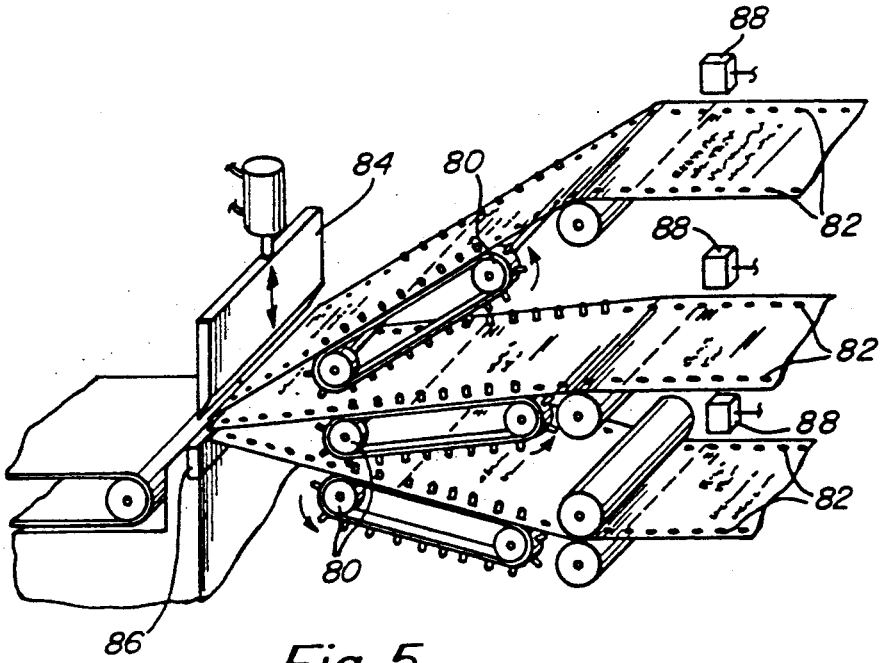
FIG. 5 is a schematic perspective view showing an alternative embodiment of the cutting and feeding elements of FIG. 3 including a reciprocating knife and tractor pin feed web drives.

While feed rollers 48 and a rotary blade 42 are utilized for feeding and cutting, respectively, according to one embodiment of this invention; it is equally possible to utilize tractor pin feed belts 80 in conjunction with tractor pin hole edged web sections 82 according to an alternative embodiment as shown in FIG. 5. Similarly, sheets may be cut by a reciprocating knife blade 84 and anvil 86 arrangement that would, necessarily, require the web to stop briefly during cutting sequences. Regardless of the type of web cutting and feeding systems employed, it is important in this and the FIG. 1–4 embodiment primarily that the contents of each web be known by the system and that the programmed stacking sequence be maintained by the CPU. To this end, detectors 88 are positioned over each fed web in FIG. 5 for determining the contents of each web and a desired feeding and cutting sequence or lack of sequence if a web is to be held in place during a particular cycle) for each web.

Figure 6:
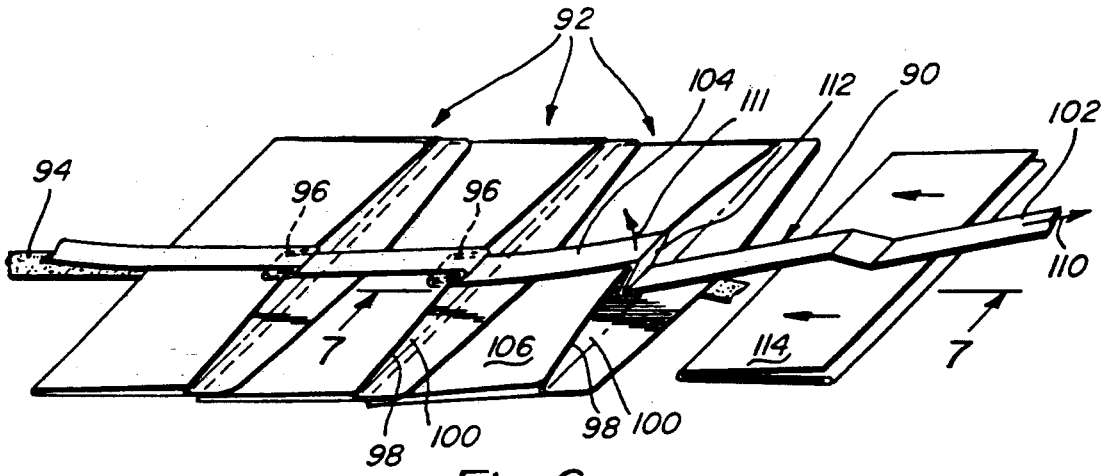
FIG. 6 is a schematic perspective view of a system for widening the openings of envelopes to facilitate insertion of contents according to this invention.
Figure 7:
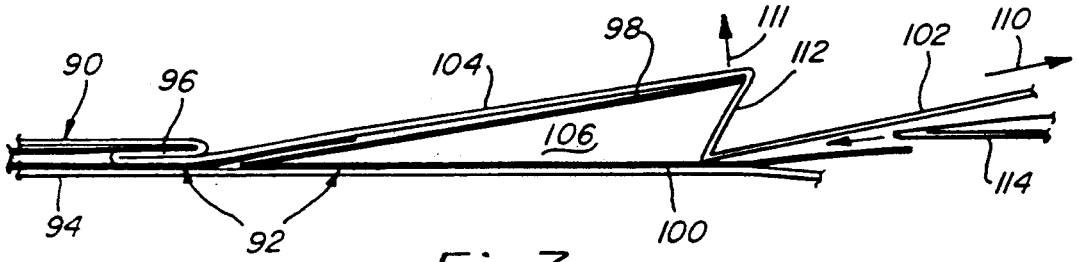
FIG. 7 is a schematic side view illustrating the widening of an envelope opening taken along line 7—7 of FIG. 6.

Since rapid and efficient feeding of envelopes to the inserter, is also important to this invention, FIGS. 6–12 detail particular improvements to the envelope insertion process. As noted, a common problem in inserting contents into envelopes is that the opening in each envelope is too narrow and closely spaced in order to quickly and effectively insert the folded sheets. As such, special machines are often utilized by inserters to spread the envelope opening sides wide enough to allow contents insertion. This process takes time and requires additional expensive equipment that is prone to breakage and frequent maintenance. FIGS. 6–7, however, depict a relatively inexpensive and reliable system for opening each envelope in turn as it is presented to the inserter. The system relies upon the natural rigidity of folded paper (or similar semi rigid web) to spread the opening sides of each envelope. In particular, a narrow material strip 90 is disposed across the top of each envelope 92 on a side of the envelope in a stream of envelopes opposite the side that contacts the tensioned roll retaining strap 94. A small fold 96 of the strip 90 is inserted inside each envelope between its opening sides 98, 100 in the stream. This strip may be as long as the entire roll of envelopes or may comprise several joined overlapping strip pieces disposed along the length of the rolled envelopes. In this embodiment, a relatively narrow strip is utilized in order to minimize material waste. As noted, either paper or similar reusable strip material may be utilized according to this embodiment as long as the material exhibits sufficient rigidity.

The upstream end 102 of the folded strip 90 is held relatively stationary by the preceding envelopes in the stream while the downstream end 104 of the strip 90, proximate the leading envelope 106, is relatively free to move forwardly in a downstream direction (arrow 110). As such, force may be exerted to pull the free downstream end 104 of the strip 90 while the upstream end 102 exiting the envelope opening remains stationary. Thus, as shown in FIG. 7, an upwardly disposed resulting force (arrow 111) occurs within the fold 112 inside the envelope 106 causing the upwardly disposed opening side 98 to spread from the lower disposed (flap carrying) opening side 100. Simultaneously, a group of folded sheets 114 may be inserted (arrow 116) between the strip 90 and the lower disposed opening side 100 with ample room for snagless insertion. The strip 90, in this embodiment, acts somewhat as a guide to aid contents insertion. As may be discerned from FIG. 7, the strip fold within each envelope opening must be sufficiently long to provide a desired widening of the envelope opening upon extension of the downstream strip end.

Figure 8:
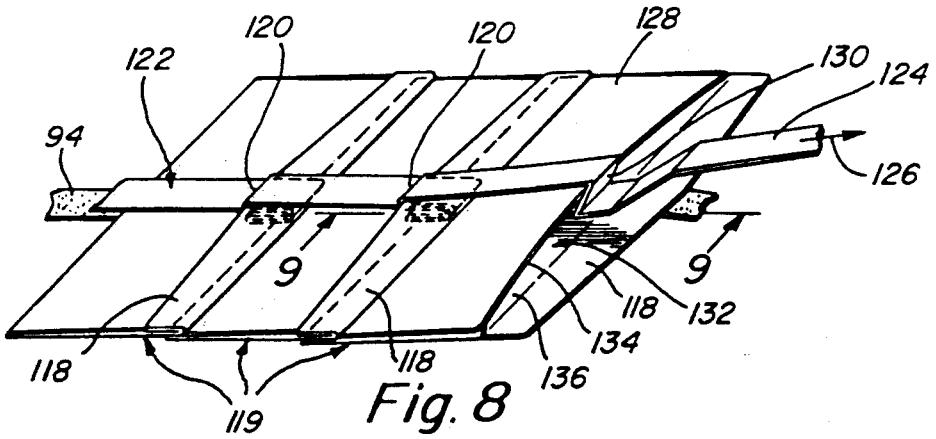
FIG. 8 is a schematic perspective view of an alternative embodiment of a system for widening the openings of envelopes wherein the flaps are closed prior to widening of the opening.
Figure 9:
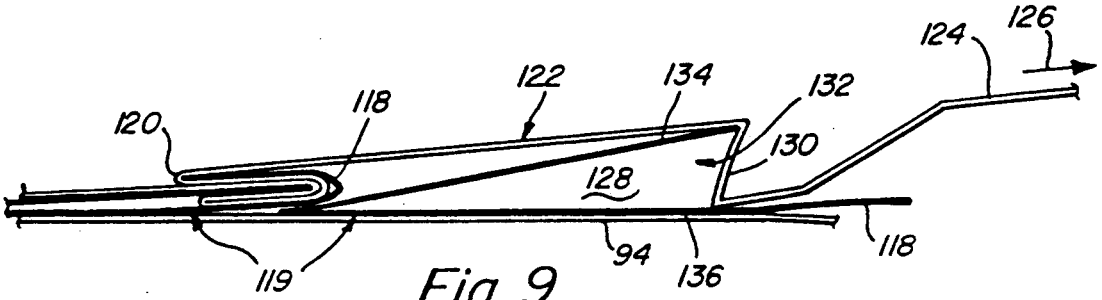
FIG. 9 is schematic side view illustrating the widening of an envelope opening taken along line 9—9 of FIG. 8.

It may be desirable to fold the flaps of each envelope into a closed position prior to insertion. This may help to preserve the gumming on the envelopes and, otherwise, reduce the space required between envelopes in a roll mounted stream, thus optimizing space. As such, an alternative embodiment is depicted in FIGS. 8–9 in which each envelope flap 118 is closed in the fed stream of envelopes 119 and a secondary fold 120 in the strip 122 is disposed around each closed flap. As the leading downstream end 124 of the strip 122 is pulled (arrow 126), the flap 118 of the leading 128 envelope first opens and then the strip fold 130 within the opening 132 causes a spread between the opening sides 134, 136. Contents may then be inserted into the widened envelope in a manner similar to that shown in FIGS. 6–7.

Figure 10:
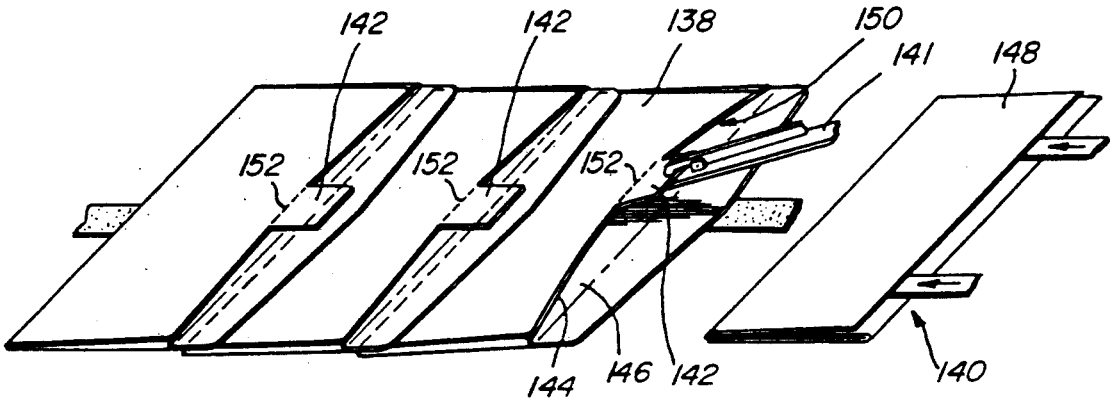
FIG. 10 is schematic perspective view of another alternative embodiment of a system for widening the openings of envelopes to facilitate insertion of contents utilizing removable tabs upon an opening edge of the envelope.
Figure 11:
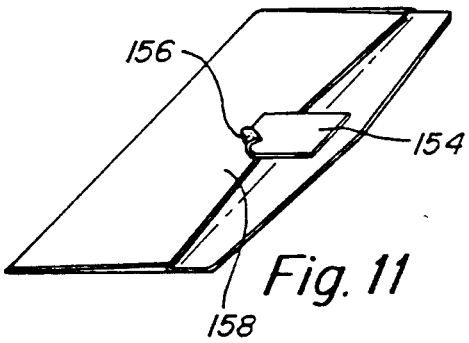
FIG. 11 is yet another alternative embodiment of a system for widening the openings of envelopes utilizing tabs that are attached by adhesive according to this invention.
Figure 12:
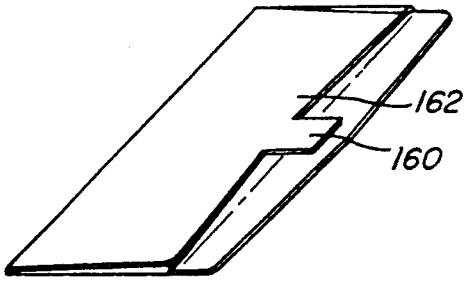
FIG. 12 is a further alternative embodiment of a system for widening the openings of envelopes utilizing tabs that are integrally attached to a side of the envelope according to this invention.

FIGS. 10–12 disclose an alternative embodiment of a system for quickly spreading the opening sides of an envelope prior to insertion. Tabs are positioned along the upwardly disposed opening side of the envelope. As the leading envelope 138 reaches the contents inserter 140, a pincer-like finger grips 141 each tab 142 in a manner depicted in FIG. 10 and moves upwardly to spread the upper and lower (flap carrying) disposed envelope opening sides 144 and 146 respectively. A folded group of sheets 148 may then be inserted easily into the envelope opening 150. The tab 142 according to this embodiment may be sized such that it is sufficiently large for grasping by the finger 141, but no larger. In this way, material waste is minimized. Tabs may be small enough that the folding of the flap upon sealing of the envelope merely folds and covers the existing tab upon each envelope. In this manner, no further operations must be performed to the tab. However, it may be desirable to remove the tab prior to contents insertion in order to prevent interference with the sealing process and, otherwise, to create a neater package. As such, the tabs 142 as depicted in FIG. 10 include precut perforations 152 that allow their easy removal by means of the pincer like finger 141 or similar gripping and pulling device.

An alternative embodiment for an envelope opening tab is depicted in FIG. 11. This tab 154 includes a tacky adhesive 156 that joins the tab 154 to the upwardly disposed envelope opening side 158. The adhesive may be strong enough to allow a finger to separate and widen the spacing between the opening sides, but may also allow easy removal of the tab upon application a predetermined pressure in a predetermined direction. For example, if the finger pulls the envelope tab 154 open at an angle, it will spread the opening sides and allow easy contents insertion. Subsequent to insertion, the finger may move directly upwardly while the envelope is held down in a fixed position. In this manner, the tab 154 could be removed from the envelope without any damage thereto. Removed tabs could be recycled or, in a case of certain resilient materials, reused for minimization of waste.

Finally, FIG. 12 depicts a second alternative embodiment of a tab system according to this invention. In this embodiment, the tabs 160 are simply extensions of the upwardly disposed envelope opening side 162. Such tabs 160 may, as described above, be folded over during sealing, or may be cut from the opening side 162 of the envelope by means of a blade subsequent to contents insertion. Again, these tabs could be recycled to minimize waste.

The foregoing has been merely a detailed description of preferred embodiments. Various modifications and alterations may be made to this invention without departing from its spirit and scope. The foregoing description is to be taken only by way of example and not in any way to limit the scope or subject matter of the invention. Rather, the invention should only be taken as limited by the following claims.

What is claimed is:

1. A method for inserting sheets into envelopes comprising the steps of:

providing a plurality of continuous webs each having a leading end by unwinding at least one web from a storage roll of continuous web;

driving selected of the leading ends in a selected order to a collection point;

cutting the selectively driven leading ends so as to form sheets at the collection point;

providing envelopes from a source; and inserting the cut sheets from the collection point into respective envelopes from the source of envelopes.

2. In a method for inserting contents into envelopes having openings, a method for widening openings of the envelopes comprising the steps of:

providing a material strip having a projecting fold therealong over a face of the envelope, the fold projecting into an opening between opposing faces of the envelope and each of opposing ends of the strip extending from the fold in each of opposing directions;

applying force to translate the opposing ends of the strip about the fold away from each other so as to expand the sections of the fold within the opening so that the faces of the envelope proximate the opening are separated from each other; and inserting contents into the envelope as the opening faces are expanded by the expanded fold.

3. A method as set forth in claim 2 further comprising the step of providing a stream of envelopes in a first direction, each of the envelopes having openings oriented in the same direction relative to the first direction and the strip of being oriented along the first direction, the strip including a plurality of folds each projecting into a respective opening of respective of the envelopes in the stream.

4. A method as set forth in claim 3 wherein the step of providing includes conveying the stream of envelopes from a roll of envelopes, the roll including a retaining strap along a side of the envelopes opposite the side of the envelopes adjacent the strip, the retaining strap maintaining the envelopes against the roll.

5. A method as set forth in claim 2 wherein the envelope includes a flap and wherein the strip includes additional folds for circumventing the flap so that the step of expanding initially opens the flap and then expands the opening faces of the envelope.

6. In a method for inserting contents into envelopes having openings, a method for widening openings of the envelopes comprising the steps of:

providing at least first and second envelopes in succession, along a first direction, each envelope having a pair of opposing faces proximate an envelope opening, each opening being remote from the preceeding opening along the first direction and facing in a similar direction, one of the faces of each envelope including a projection therefrom extending outwardly away from an opening edge of the face;

gripping the projection on the first envelope and moving the projection in a second direction so as to widen a spacing between the envelope opening faces;

inserting contents into the envelope as the opening faces are widened;

releasing the projection; and repeating each of the gripping, inserting, and releasing steps for the second envelope.

7. In a method for inserting contents into envelopes having openings, a method for widening openings of the envelopes comprising the steps of:

providing an envelope having a pair of opposing faces proximate an envelope opening, one of the faces including a projection therefrom extending outwardly away from an opening edge of the face;

gripping the projection and moving the projection in a direction so as to widen a spacing between the envelope opening faces; and inserting contents into the envelope as the opening faces are widened removing the projection subsequent to the step of inserting.

8. A method as set forth in claim 7 wherein the step of removing comprises tearing the projection along preformed perforations.

9. A method as set forth in claim 7 wherein the projection comprises a tab attached by adhesive to the face of the envelope proximate the opening edge and the step of removing comprises pulling the tab from the envelope in a manner that breaks an adhesive contact between the envelope and the tab.

10. An apparatus for widening openings of envelopes to facilitate insertion of contents thereinto comprising:

a strip of material having a fold therealong, the fold being inserted into an opening in two faces of an envelope and the strip having a pair of opposite ends extending in opposite directions from the fold transversely to an edge of the opening so that applying force to extend the opposite ends from each other in each of opposite directions causes the fold to expand to widen a spacing between the envelope opening faces.

11. An apparatus as set forth in claim 10 wherein the strip of material includes a plurality of folds constructed and arranged to be positioned in the openings of a plurality of envelopes, the envelopes being disposed in a stream.

12. An apparatus as set forth in claim 11 wherein each of the envelopes in the stream includes an opening oriented in a like direction and wherein each of the folds is oriented in a like direction and is positioned in a respective opening.

13. An apparatus for widening openings of envelopes to facilitate insertion of contents thereinto comprising:

a projection attached to one of opposing faces of an envelope proximate one of a pair of opening-defining edges of one of the faces, the projection formed continuously as part of the envelope face, the projection being located so that griping and pulling of the projection widens spacing between the envelope opening-defining edges.

14. An apparatus as set forth in claim 13 wherein the projection comprises a tab extending from one of the opening-defining edges of the envelope.

15. An apparatus for widening openings of envelopes to facilitate insertion of contents thereinto comprising:

a tab extending from one of a pair of opening-defining edges of the envelope, the tab being located so that gripping and pulling of the tab widens spacing between the envelope opening-defining edges, the tab being an approximately square flap of material formed continuously as a part of the envelope face.

16. An apparatus as set forth in claim 15 wherein the tab includes preformed perforations positioned approximately in a line along a line of the opening-defining edge so that the tab is removable by tearing the perforations.

17. An apparatus as set forth in claim 15 wherein the tab includes a contact adhesive thereon for attaching the tab to the face proximate an opening-defining edge.

18. An apparatus as set forth in claim 17 wherein the adhesive comprises an adhesive having a strength sufficient to allow the tab to pull the opening-defining edge away from an opposite opening-defining edge upon application of a first predetermined force and the adhesive having a strength further sufficient to allow removal of the tab from the envelope without damage to the face of the envelope upon application of a second predetermined force in a predetermined direction.

19. A method for inserting sheets into envelopes comprising the steps of:

providing a plurality of continuous webs each having a leading end;

driving selected of the leading ends in a selected order to a collection point;

cutting the selectively driven leading ends so as to form sheets at the collection point;

providing envelopes from a source; and inserting the cut sheets from the collection point into respective envelopes from the source of envelopes.

20. A method as set forth in claim 19 wherein the step of cutting includes separating a plurality of overlaid leading ends in a single operation into a plurality of overlaid sheets at the collection point.

21. A method as set forth in claim 19 further comprising the step of folding at least one of the sheets prior to the step of inserting.

22. A method as set forth in claim 19 further comprising the step of widening an opening of each of the envelopes for insertion of sheets thereinto.

23. A method as set forth in claim 22 wherein the step of widening includes providing a strip over each of the envelopes transferred from the source, the strip including a fold projecting into each of the envelope openings, a leading edge of the strip being pulled to expand the fold in the strip to widen a respective envelope opening.

24. A method as set forth in claim 23 wherein the step of providing includes providing a strip having additional folds to circumvent an envelope flap disposed in a closed position and wherein the pulling of the leading edge of the strip opens the fold.

25. A method as set forth in claim 22 wherein the step of widening includes gripping a preformed tab upon an opening side, opposite a flap side, of the envelope.

26. A method as set forth in claim 25 wherein the step of gripping further include removing the tab from the envelope subsequent to the step of inverting sheets into the envelope.

27. A method as set forth in claim 26 wherein the step of removing comprises tearing the tab from the envelope along preformed perforations.

28. A method as set forth in claim 26 wherein the tab is attached to the envelope by adhesive and wherein the step of removing comprises pulling the tab from the envelope in a manner that breaks an adhesive contact between the tab and the envelope.

29. A method as set forth in claim 19 further comprising widening openings of envelopes to allow an easier insertion of contents thereinto, the step of widening including expanding a folded material piece, the folded piece being disposed within the opening and projecting therefrom.

30. An apparatus for insertion of sheets into envelopes comprising:

a plurality of disconnected sources of continuous web, each of the disconnected sources having a leading end;

a driver that directs the leading end of each of the continuous webs to a collection point, the driver including a controller to direct selected of the web leading ends from selected of the disconnected sources to the collection point in a selected order;

a cutter that cuts leading ends positioned at the collection point into separated sheets;

a source of envelopes; and an inserter that inserts the separated sheets from the collection point into a corresponding envelope from the source of envelopes.

31. An apparatus as set forth in claim 30 wherein at least one continuous web control codes thereon and wherein the controller includes a web print sensor for reading control codes to instruct the controller.

32. An apparatus as set forth in claim 31 wherein the control codes comprise bar codes and the detector comprises a bar code detector.

33. An apparatus as set forth in claim 30 further comprising a folder for folding sheets transferred from the collection point.

34. An apparatus as set forth in claim 30 wherein predetermined of the envelopes include markings and wherein the controller includes a detector for identifying envelopes having markings thereon for insertion into the envelopes of predetermined sheets from the collection point.

35. An apparatus as set forth in claim 30 further comprising an envelope opening spreader to facilitate rapid insertion of sheets into the envelopes.

36. An apparatus as set forth in claim 30 wherein at least one of the continuous webs comprises a slit and merged web having a pair of leading ends overlying each other at the collection point.

37. An apparatus as set forth in claim 30 wherein the cutter includes a blade constructed and arranged to cut a plurality of overlying leading ends at the collection point into a stack of separated sheets in a single operation.

38. An apparatus as set forth in claim 30 wherein the plurality of continuous webs comprises at least three webs having leading ends that overlay each other proximate to and upstream of the collection point in a web directing direction.

39. An apparatus as set forth in claim 30 wherein the collection point includes a conveyor for transferring the separated sheets to the inserter.

40. An apparatus for insertion of sheets into envelopes comprising:

a plurality of sources of continuous web, each of the sources having a leading end;

a driver for directing the leading end of each of the continuous webs to a collection point, the driver including a controller to direct web leading ends to the collection point in a selected order from selected of the continuous webs;

a cutter for cutting leading ends positioned at the collection point into separated sheets;

a source of envelopes;

an inserter for inserting the separated sheets from the collection point into a corresponding envelope from the source of envelopes; and an envelope opening spreader to facilitate rapid insertion of sheets into the envelopes, including a tab positioned along an opening side of the envelope opposite a flap side of the envelope and wherein the inserter includes a gripper for gripping the tab to widen the opening for insertion of contents thereinto.

41. An apparatus as set forth in claim 40 wherein the tab comprises an outwardly disposed extension of an opening side of the envelope opposite the flap side thereof.

42. An apparatus as set forth in claim 41 further comprising a cutter for removing the tab from the envelope.

43. An apparatus as set forth in claim 40 wherein the tab includes perforations for removal of the tab from the envelope.

44. An apparatus as set forth in claim 40 wherein the tab includes adhesive for removably attaching the tab to the envelope, the adhesive having a sufficient strength to allow widening of the envelope upon pulling by the gripper and further allowing non-damaging removal of the tab from the envelope upon application of predetermined force to remove the tab.

45. An apparatus for insertion of sheets into envelopes comprising:

a plurality of sources of continuous web, each of the sources having a leading end, and at least one continuous web including control codes thereon, said control codes comprising bar codes;

a driver for directing the leading end of each of the continuous webs to a collection point, the driver including a controller to direct web leading ends to the collection point in a selected order from selected of the continuous webs, the controller including a web print sensor for reading the control codes to instruct the controller, the sensor comprising a bar code detector;

a cutter for cutting leading ends positioned at the collection point into separated sheets;

an inserter for inserting the separated sheets from the collection point into a corresponding envelope from a source of envelopes; and the source of envelopes including a roll core support and an opposing retaining strap for maintaining envelopes against the roll core, the envelopes being unrolled for feeding into the inserter.

46. An apparatus for insertion of sheets into envelopes comprising;

a plurality of sources of continuous web, each of the sources having a leading end;

a driver for directing the leading end of each of the continuous webs to a collection point, the driver including a controller to direct web leading ends to the collection point in a selected order from selected of the continuous webs;

a cutter for cutting leading ends positioned at the collection point into separated sheets;

a source of envelopes;

an inserter for inserting the separated sheets from the collection point into a corresponding envelope from the source of envelopes; and an envelope opening spreader, to facilitate rapid insertion of sheets into the envelopes, including a strip positioned upon an envelope side opposite a side having a flap, the strip having a folded portion inserted into each envelope at an opening thereof so that pulling upon a free end of the strip causes the opening of the envelope to widen for insertion of contents thereinto.

47. An apparatus as set forth in claim 46 wherein the envelopes include flaps disposed in a closed position and the strip includes folds for circumventing the folded flaps.

48. A method for inserting sheets into envelopes comprising the steps of:

providing a plurality of continuous webs each having a leading end;

driving a plurality of leading ends from at least one continuous web in a selected order to a collection point;

cutting a plurality of sheets from the leading ends at the collection point so as to form a stack of sheets at the collection point;

providing envelopes from a source; and inserting the cut sheets from the collection point into respective envelopes from the source of envelopes.

49. A method as set forth in claim 48 wherein the step of inserting comprises inserting a stack of sheets from the collection point into a respective envelope from the source of envelopes.

50. A method for inserting sheets into envelopes comprising the steps of:

providing a plurality of continuous webs each having a leading end;

driving selected of the leading ends in a selected order to a collection point;

cutting the selectively driven leading ends so as to form sheets at the collection point;

providing envelopes by transferring envelopes from a roll of envelopes; and inserting the cut sheets from the collection point into respective envelopes form the source of envelopes.

51. A method as set forth in claim 50 wherein the step of transferring includes maintaining the envelopes against a roll with an opposing retaining strap that is paid out as the envelopes are unrolled from the roll.

* * * * *